United States Patent [19]

Marling

[11] 4,325,555

[45] Apr. 20, 1982

[54] GAME USING AIR BLOWERS TO MOVE OBJECT

[76] Inventor: Douglas S. Marling, 2511 Elizabeth St., Janesville, Wis. 53545

[21] Appl. No.: 141,208

[22] Filed: Apr. 17, 1980

[51] Int. Cl.[3] ..... A63F 9/02

[52] U.S. Cl. ..... 273/355; 273/119 B; 273/357

[58] Field of Search ..... 273/349, 355, 356, 357, 273/405, 85 H, 119 B, 86 D, 388; 124/55; 46/44

[56] References Cited

U.S. PATENT DOCUMENTS 2,678,215 5/1954 Peterson et al. ..... 273/127 R X
4,135,559 1/1979 Barnby ..... 273/349

FOREIGN PATENT DOCUMENTS 266415 7/1929 Italy ..... 273/119 B
2018607 10/1979 United Kingdom ..... 273/85 H

*Primary Examiner*—Anton O. Oechsle
*Attorney, Agent, or Firm*—Larson and Taylor

[57] ABSTRACT

A game apparatus using air jets from a pair of air blowers to move one or more objects. The pair of air blowers are mounted in opposed relationship on guide means and the object is placed between the two air blowers. With the air blowers connected to a source of pressurized air, the goal of the game is to use air jets from the air blowers to move the object to a desired location. The object can be a vaned rotor mounted on a threaded rod. In the latter embodiment, each player uses the air jet from his air blower to attempt to move the vaned rotor in a given direction along the threaded rod to a predetermined end of the rod in order to win the game.

5 Claims, 5 Drawing Figures

GAME USING AIR BLOWERS TO MOVE OBJECT

FIELD OF THE INVENTION

This invention relates to game apparatus for games which use air jets and the like to move an object to a predetermined location.

BACKGROUND OF THE INVENTION

A number of games provide for the use of an air jet or jets to move an object as part of the game. For example, in U.S. Pat. No. 743,820 to Brown, a game is disclosed in which plural air jets are used to blow game pieces around on the surface of water. Further, in U.S. Pat. No. 790,895 to Henrichsen, a game device is disclosed in which air jets turn wheel arrangements so as to control the position of simulated racing horses. There are also game apparatus using streams of water rather than jets of air to move an object. For example, in U.S. Pat. No. 4,135,559 to Barnby, a water squirt toy is disclosed which can be used with a variety of amusement apparatus including a vaned rotor mounted for movement along a threaded rod.

There are a number of disadvantages associated with game devices which use air jets to move an object. For example, the distance between the object to be moved by the air jet and the source of the air jet is variable over a large distance. Thus, the force of the air jet impinging on the object to be moved is also variable. In some instances, the source of the air jet may be too far away to move the object, while in other instances the source may be too close to the object so that the air jet overpowers the movement of the object. In addition, since the air jets exert the greatest force nearest the source of the jets, the players tend to place their source as close to the object as possible and often the object is touched and/or moved unfairly by the source itself rather than the air jet.

SUMMARY OF THE INVENTION

In accordance with the present invention, a game apparatus is provided with a pair of air blowers having nozzles for directing a stream of air against an object or objects to be moved. The air blowers are mounted facing each other on guide means so as to be freely movable thereon and each air blower is connected to a suitable source of pressurized air. With the object placed between the two air blowers, the object can be moved by the jets of air issuing from the air blowers. As the object moves, the air blowers can move along the guide means but the blowers are never closer to the object than the distance determined by the guide means. Thus, one player cannot obtain an unfair advantage by moving his air blower closer to the object, but is instead constrained to move the air blower along the guide means to the most advantageous position.

According to a preferred embodiment, the air blowers are mounted on parallel guide bars. Located between the guide bars is a threaded rod on which a vaned rotor is threadably received. In this embodiement, pressurized air is supplied from hand operated pumps located at each end of the guide means. With this game apparatus, the object of the game is to direct the stream of air issuing from the air blowers to cause the vaned rotor to turn on the threaded rod and travel to one end of the rod. Each player attempts to cause the rotor to travel towards an opposite end by directing the air stream from his air blower appropriately to this task.

Other features and advantages of the present invention are stated in or apparent from the detailed description of a presently preferred embodiment of the invention found hereinbelow.

DETAILED DESCRIPTION OF THE PREFERRED EMBODIMENTS

Figure 1:
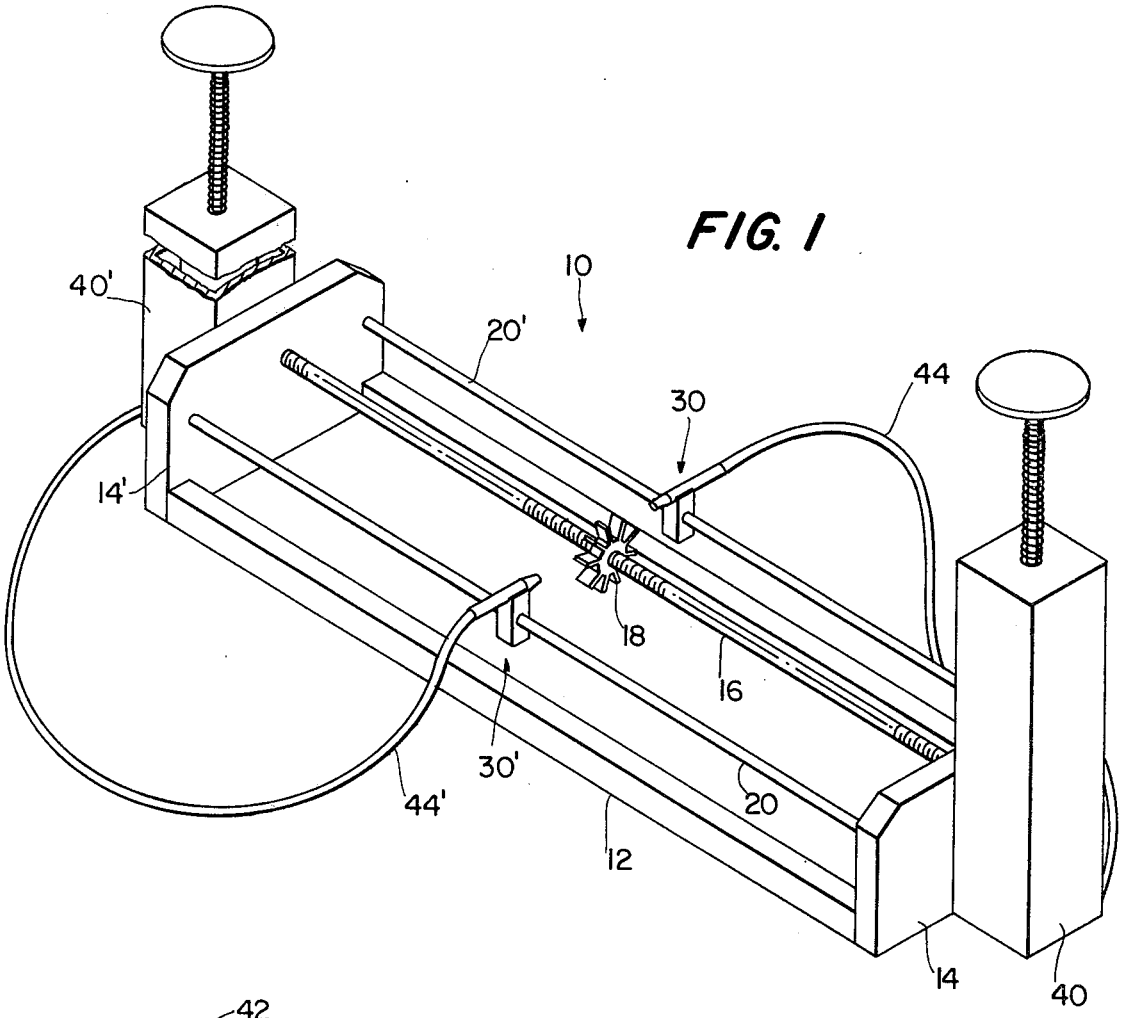
FIG. 1 is a perspective view of the game apparatus of the present invention.

With reference now to the drawings in which like numerals represent like elements throughout the several views, a presently preferred embodiment of the present invention is depicted in FIG. 1 and comprises a game apparatus 10 having a base 12. In this embodiment of the invention, base 12 is rectangularly shaped and has two upstanding ends 14 and 14' attached along the short sides of base 12. Mounted between ends 14 and 14' above the center of base 12 is a threaded rod 16. A vaned rotor 18 with matching threads is received on threaded rod 16. Also mounted between ends 14 and 14' are two guide bars 20 and 20'. These guide bars 20 and 20', which extend parallel to and are disposed equidistant from threaded rod 16, serve to mount respective air blowers 30 and 30' for movement therealong.

Figure 2:
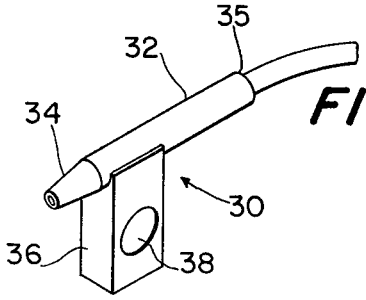
FIG. 2 is a perspective view showing one of the air blowers of FIG. 1.

The air blowers 30 and 30' are similar and air blower 30, which is shown in greater detail in FIG. 2 will be considered as exemplary. Air blower 30 is comprised of a cylindrical pipe member 32 having a nozzle 34 at one end and a hose receiving end 35 at the other end. Attached to pipe member 32 is a mounting bracket 36 with an aperture 38 therein. As is shown more clearly in FIG. 1, air blower 30 is mounted on guide bar 20 with nozzle 34 facing towards threaded rod 16. Blower 30 is so mounted by passing guide bar 20 through aperture 38 in mounting bracket 36. With this construction, air blower 30 is freely movable along guide bar 20, and air blower 30 can also pivot about guide bar 20. The second air blower 30' is, of course, similarly positioned on guide bar 20'.

Figure 3:
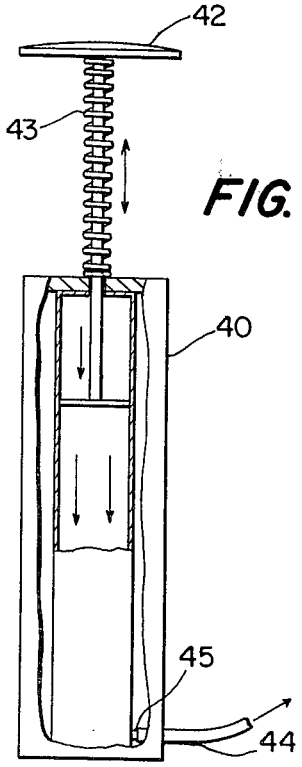
FIG. 3 is a partially cut-away side view of one of the air pumps used in FIG. 1.

In order to provide a source of pressurized air for air blowers 30 and 30', two hand operated air pumps 40 and 40' are employed. Conveniently, air pumps 40 and 40' can simply be attached to ends 14 and 14' respectfully. As shown more clearly in FIG. 3, air pump 40 is a simple piston type pump operated by a handle 42. Handle 42 is returned to an operative position at the end of each stroke by a spring 43. A flexible hose 44 is used to connect the outlet 45 of pump 40 to the hose receiving end 35 of air blower 30. Pump 40' is similarly connected to air blower 30'.

A game employing the game apparatus 10 of FIGS. 1 to 4 is played in the following manner. Initially, vaned rotor 18 is positioned on threaded rod 16 at the midpoint between ends 14 and 14'. As the game commences, each of the two players grasps the handle 42 or 42', respectively, which powers the associated pump 40 or 40' supplying pressurized air to that player's air blower 30 or 30'. By properly positioning his air blower 30 or 30' to direct a jet of air onto vaned rotor 18, each player attempts to turn rotor 18 in a direction so as to advance rotor 18 along threaded rod 16 to one end 14 or 14'. It will be appreciated that air from blowers 30 and 30' will cause the vaned rotor 18 to rotate in opposite directions and thus cause the rotor 18 to move in opposite directions along rod 16. As rotor 18 is moved, air blowers 30 and 30' are moved along guide bars 20 and 20' so as to maintain the blowers in the most advantageous position, both laterally and pivotally. The game is completed when rotor 18 reaches one of the two ends 14, 14'.

Figure 5:
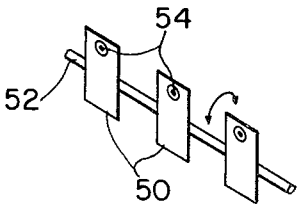
FIG. 5 is a perspective view of spinable cards which can also be used with the present invention.
Figure 4:
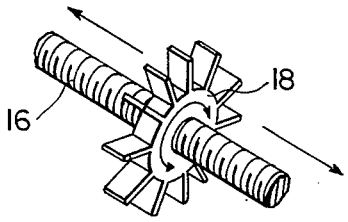
FIG. 4 is a perspective view of the vaned rotor shown in FIG. 1.

Depicted in FIG. 5 is a series of cards 50 mounted on a rod 52. Each card 50 is independently rotatable on rod 52 and has a colored circle 54 on one side. In an alternative embodiment of the present invention, rod 52 is mounted between ends 14 and 14' in place of threaded rod 16, and the object of the game is to rotate and stop each card using air blowers 30 or 30' so that all four cards end up with the colored circle on one player's side.

It should be noted that a variety of other different games may be envisioned which use the guided air blowers of the invention and these games need not include a vaned rotor or rotatable cards such as described above. It would also be possible to orient the guide bars differently, i.e., vertically, and to provide additional guide bars. In addition, a plurality of air blowers could be provided for each player and the air blowers could also be modified to pivot from side to side as well as in the manner shown.

Thus while the invention has been described in detail with respect to an exemplary embodiment thereof, it will be understood by those of ordinary skill in the art that these and other variations and modifications may be effected in the exemplaryembodiment within the scope and spirit of the invention.

I claim:

1. A game apparatus comprising:

a source of pressurized air;

a pair of air blowers disposed in opposed relationship to each other and each having nozzles for projecting pressurized air in a jet;

means for connecting said source of pressurized air with said pair of air blowers;

an object located between said air blowers and movable responsive to a jet of air projected thereon from said air blowers;

means for guiding and constraining the movement of said object so as to be equidistant from and in front of said pair of air blowers; and a pair of substantially rigid elongate guide means for mounting respective ones of said pair of air blowers so that said pair of air blowers are freely movable therealong and pivotable only in a plane perpendicular to the longitudinal axis of a respective guide means and for guiding the movement of said air blowers such that the air blowers are constrained to move along said guide means and are positionable directly in front of said object as said object moves.

2. A game apparatus as claimed in claim 1 further including a base and wherein said source of pressurized air includes a pair of hand operated air pumps located on opposite sides of said base, each of said pumps supplying air to one of said pair of air blowers.

3. A game apparatus as claimed in claim 1 wherein said pair of guide means includes a pair of guide bars, one of said pair of air blowers being mounted on each guide bar.

4. A game apparatus as claimed in claim 3 wherein said pair of guide bars are mounted parallel to each other so as to maintain said pair of opposed air blowers separated from each other by a fixed distance.

5. A game apparatus as claimed in claim 4 wherein said object guiding and constraining means comprises a threaded rod located equidistant between said pair of guide bars, and wherein said object comprises a vaned rotor threadably received on said threaded rod so as to move along said threaded rod as said rotor is turned by the jets of air projected from said air blowers.

* * * * *